US009852682B2

(12) United States Patent
Lee et al.

(10) Patent No.: US 9,852,682 B2
(45) Date of Patent: Dec. 26, 2017

(54) ORGANIC LIGHT-EMITTING DISPLAY CONFIGURED TO CORRECT IMAGE DATA AND METHOD OF DRIVING THE SAME

(71) Applicant: SAMSUNG DISPLAY CO., LTD., Yongin, Gyeonggi-Do (KR)

(72) Inventors: Dong Hwan Lee, Yongin-si (KR); Ju Gon Seok, Suwon-si (KR); In Soo Lee, Seongnam-si (KR); Seung Kyun Hong, Cheonan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 42 days.

(21) Appl. No.: 14/446,268

(22) Filed: Jul. 29, 2014

(65) Prior Publication Data

US 2015/0294625 A1 Oct. 15, 2015

(30) Foreign Application Priority Data

Apr. 15, 2014 (KR) ..... 10-2014-0044833

(51) Int. Cl.
*G09G 3/30* (2006.01)
*G09G 3/3233* (2016.01)

(52) U.S. Cl.
CPC ... *G09G 3/3233* (2013.01); *G09G 2300/0861* (2013.01); *G09G 2320/0242* (2013.01); *G09G 2320/0285* (2013.01); *G09G 2340/16* (2013.01)

(58) Field of Classification Search
CPC ..... G09G 3/3233; G09G 2320/0285; G09G 2340/16
USPC ..... 345/690, 82, 76
See application file for complete search history.

(56) References Cited

U.S. PATENT DOCUMENTS

| | | | | |
|---|---|---|---|---|
| 8,184,123 | B2 * | 5/2012 | Nagase | G09G 3/2022 345/428 |
| 2008/0068310 | A1 * | 3/2008 | Choi | G09G 3/3233 345/82 |
| 2011/0254874 | A1 * | 10/2011 | Kikuta | G09G 3/2092 345/690 |
| 2011/0316892 | A1 * | 12/2011 | Sung | G09G 3/3233 345/690 |
| 2013/0201223 | A1 * | 8/2013 | Li | G09G 3/2022 345/690 |
| 2014/0092144 | A1 * | 4/2014 | Kim | G09G 3/3233 345/690 |

FOREIGN PATENT DOCUMENTS

| | | |
|---|---|---|
| KR | 10-2009-0093073 A | 9/2009 |
| KR | 10-2011-0026225 A | 3/2011 |
| KR | 10-2011-0027128 A | 3/2011 |
| KR | 10-1374507 B1 | 3/2014 |

OTHER PUBLICATIONS

Korean Patent Abstract in 10-2008-003999 corresponds to KR 10-1374507 B1, 1 pg.

* cited by examiner

*Primary Examiner* — Yuzhen Shen
(74) *Attorney, Agent, or Firm* — Lewis Roca Rothgerber Christie LLP

(57) ABSTRACT

An organic light-emitting display includes a display unit including a plurality of pixels; and a controller configured to correct first image data having a first gray level, which is included in image data, to have a second gray level higher than the first gray level, wherein the controller is configured to correct the first image data at intervals of N frames, where N is an integer of one or more.

13 Claims, 11 Drawing Sheets

FIG. 11

LUT1

| | | | | |
|---|---|---|---|---|
| RGB (030) | RGB (000) | RGB (030) | . . . | RGB (000) |
| RGB (000) | RGB (030) | RGB (000) | . . . | RGB (030) |
| RGB (030) | RGB (000) | RGB (030) | . . . | RGB (000) |
| ⋮ | ⋮ | ⋮ | ⋱ | |
| RGB (000) | RGB (030) | RGB (000) | | RGB (030) |

FIG. 12

LUT2

| | | | | |
|---|---|---|---|---|
| RGB (000) | RGB (030) | RGB (000) | . . . | RGB (030) |
| RGB (030) | RGB (000) | RGB (030) | . . . | RGB (000) |
| RGB (000) | RGB (030) | RGB (000) | . . . | RGB (030) |
| ⋮ | ⋮ | ⋮ | ⋱ | |
| RGB (030) | RGB (000) | RGB (030) | | RGB (000) |

ORGANIC LIGHT-EMITTING DISPLAY CONFIGURED TO CORRECT IMAGE DATA AND METHOD OF DRIVING THE SAME

CROSS-REFERENCE TO RELATED APPLICATION

This application claims priority to and the benefit of Korean Patent Application No. 10-2014-0044833 filed on Apr. 15, 2014 in the Korean Intellectual Property Office, the disclosure of which is incorporated herein by reference in its entirety.

BACKGROUND

1. Field

Aspects of embodiments of the present invention relate to an organic light-emitting display and a method of driving the same.

2. Description of the Related Art

Displays are being used as displays for portable information terminals such as personal computers (PCs), mobile phones, and personal data assistants (PDAs), or as monitors for various information and electronic devices. Currently, various light-emitting displays, which are lighter in weight and smaller in volume than cathode ray tubes (CRTs), are being developed. In particular, organic light-emitting displays are drawing attention due to their excellent emission efficiency, luminance, and viewing angle, as well as fast response speed.

An organic light-emitting display includes a plurality of pixels. Each of the pixels includes a red subpixel, which includes a red organic light-emitting layer, a green subpixel, which includes a green organic light-emitting layer, and a blue subpixel, which includes a blue organic light-emitting layer. Each of the pixels expresses a certain color by mixing red light, green light, and blue light emitted respectively from the red, green, and blue subpixels.

Because the light-emitting layers of the subpixels are formed of different materials, they may have different electrical characteristics such as chemical characteristics and electric current mobility. Accordingly, when a pixel displays white after displaying black during a number of frames, certain subpixels may be delayed in emitting light to a desired luminance level, compared with other subpixels, which may result in color blurring.

SUMMARY

Aspects of embodiments of the present invention provide an organic light-emitting display, which may prevent or reduce color blurring by compensating for the emission delay of each subpixel.

However, aspects of the present invention are not restricted to the embodiments set forth herein. The above and other aspects of the present invention will become more apparent to one of ordinary skill in the art to which the present invention pertains by referencing the detailed description of the present invention given below.

Aspects of example embodiments of the present invention include an organic light-emitting display including: a display unit including a plurality of pixels; and a controller configured to correct first image data having a first gray level, which is included in image data, to have a second gray level higher than the first gray level, wherein the controller is configured to correct the first image data at intervals of N frames, where N is an integer of one or more.

The controller may include: an image data analyzer configured to analyze whether or not the image data includes the first image data; a corrected image data generator configured to output a selection signal at the intervals of the N frames; and a memory configured to provide correction data to the corrected image data generator in response to the selection signal, wherein the corrected image data generator is configured to generate corrected image data by correcting the first image data, which is included in the image data, based on the correction data.

The image data may include first color image data, second color image data, and third color image data, and each of the pixels may include: a first subpixel configured to display the first color image data; a second subpixel configured to display the second color image data; and a third subpixel configured to display the third color image data.

The controller may be configured to correct the first gray level of the first image data included in at least one of the first color image data, the second color image data, and the third color image data to the second gray level.

Each of the first, second, and third subpixels may include: an organic light-emitting diode configured to emit light of a first color, a second color, or a third color; a driving transistor configured to control a driving current flowing through the organic light-emitting diode; and a driving capacitor configured to provide a gate voltage to the driving transistor.

The driving capacitor may be configured to be charged with a data voltage corresponding to the second gray level at the intervals of the N frames.

The data voltage corresponding to the second gray level may cause an anode voltage of the organic light-emitting diode to be lower than a threshold voltage of the driving transistor.

The first gray level may have a gray value of zero, and the first image data may be black data.

Aspects of example embodiments of the present invention include an organic light-emitting display including: a display unit including a plurality of pixels; and a controller configured to correct first image data having a first gray level, which is included in image data, to have a second gray level higher than the first gray level based on first correction data or second correction data provided alternately at intervals of N frames, wherein a pixel displaying the first image data corrected based on the first correction data and a pixel displaying the first image data corrected based on the second correction data are different, where N is an integer of one or more.

The controller may include: an image data analyzer configured to analyze whether or not the image data includes the first image data; a corrected image data generator configured to alternately output a first selection signal and a second selection signal at the intervals of the N frames; and a memory configured to provide the first correction data and the second correction data to the corrected image data generator in response to the first selection signal and the second selection signal, respectively, wherein the corrected image data generator may be configured to generate the corrected image data by correcting the first image data, which is included in the image data, based on the first correction data or the second correction data.

The image data may include first color image data, second color image data, and third color image data, and each of the pixels may include: a first subpixel configured to display the first color image data; a second subpixel configured to display the second color image data; and a third subpixel configured to display the third color image data.

The controller may be configured to correct the first gray level of the first image data included in at least one of the first color image data, the second color image data, and the third color image data to the second gray level.

When a first pixel of the pixels displays the first image data corrected by the first correction data, a second pixel of the pixels neighboring the first pixel in a column or row direction may display the first image data corrected by the second correction data.

When a first pixel of the pixels displays the first image data corrected by the first correction data, a second pixel of the pixels neighboring the first pixel in a column or row direction may display the first image data corrected by the second correction data.

The first gray level may have a gray value of zero, and the first image data may be black data.

Aspects of example embodiments of the present invention include a method of driving an organic light-emitting display, the method including: analyzing image data input from an external source; generating corrected image data by correcting first image data having a first gray level, which is included in the image data, to have a second gray level higher than the first gray level; and displaying an image corresponding to the corrected image data, wherein the corrected image data is generated by correcting the first image data at intervals of N frames.

The analyzing of the image data may include determining whether or not the image data includes the first image data.

The method may further include selecting correction data for the generating of the corrected image data after the analyzing of the image data, wherein the selecting of the correction data may include reading out the correction data by outputting a selection signal at the intervals of the N frames.

The image data may include first color image data, second color image data, and third color image data, and in the generating of the corrected image data, the first gray level of first image data included in at least one of the first color image data, the second color image data, and the third color image data may be corrected to the second gray level.

The first gray level may have a gray value of zero, and the first image data may be black data.

BRIEF DESCRIPTION OF THE DRAWINGS

The above and other aspects and features of the present invention will become more apparent by describing in detail example embodiments thereof with reference to the attached drawings, in which:

FIG. 11 is a schematic diagram of first correction data according to an embodiment of the present invention;

FIG. 12 is a schematic diagram of second correction data according to an embodiment of the present invention;

DETAILED DESCRIPTION

Figure 1:
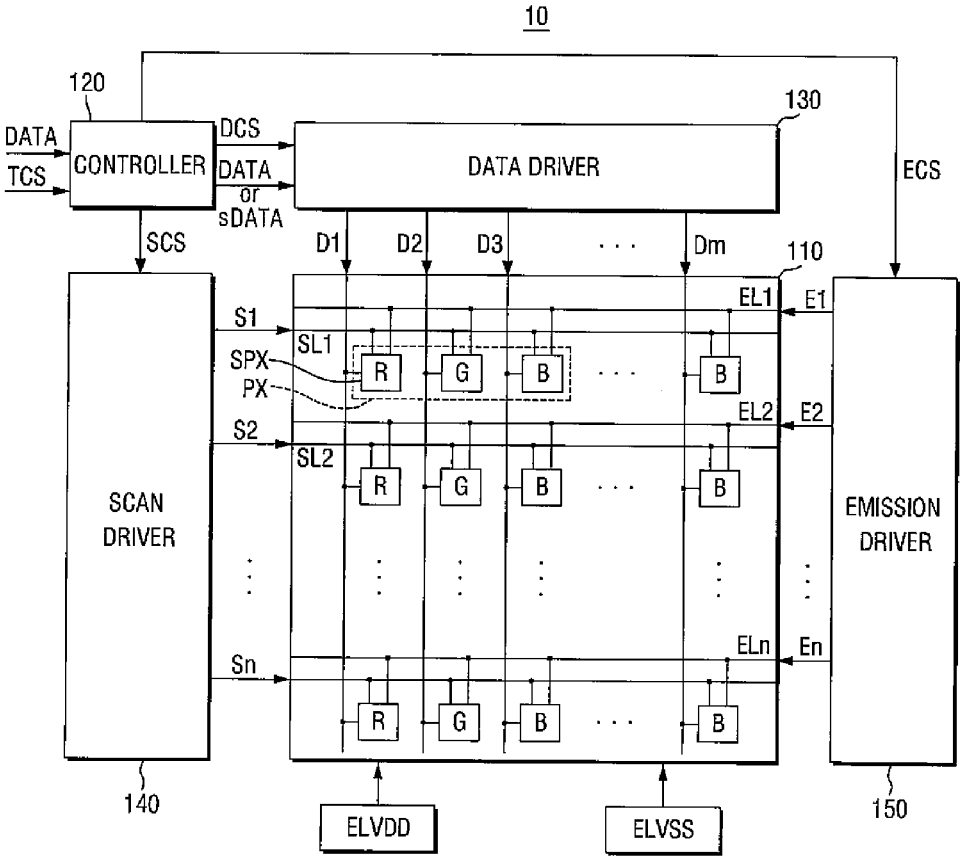
FIG. 1 is a block diagram of an organic light-emitting display according to an embodiment of the present invention.

Aspects and features of the present invention and methods of accomplishing the same may be understood more readily by reference to the following detailed description of example embodiments and the accompanying drawings. The present invention may, however, be embodied in many different forms and should not be construed as being limited to the embodiments set forth herein. Rather, these embodiments are provided so that this disclosure will be more thorough and more complete and will more fully convey the concept of the invention to those skilled in the art, and the present invention will be defined by the appended claims, and their equivalents. Thus, in some embodiments, some well-known structures and devices may not be shown for brevity of the description. Like numbers refer to like elements throughout. In the drawings, the thickness of layers and regions are exaggerated for clarity.

It will be understood that when an element or layer is referred to as being "on," "connected to," or "coupled to" another element or layer, it can be directly on, directly connected to, or directly coupled to the other element or layer, or intervening elements or layers may be present. In contrast, when an element is referred to as being "directly on," "directly connected to," or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, these elements should not be limited by these terms. These terms are only used to distinguish one element from another element. Thus, for example, a first element, a first component, or a first section discussed below could be termed a second element, a second component, or a second section without departing from the teachings of the present invention.

Hereinafter, embodiments of the present invention will be described with reference to the attached drawings.

Figure 2:
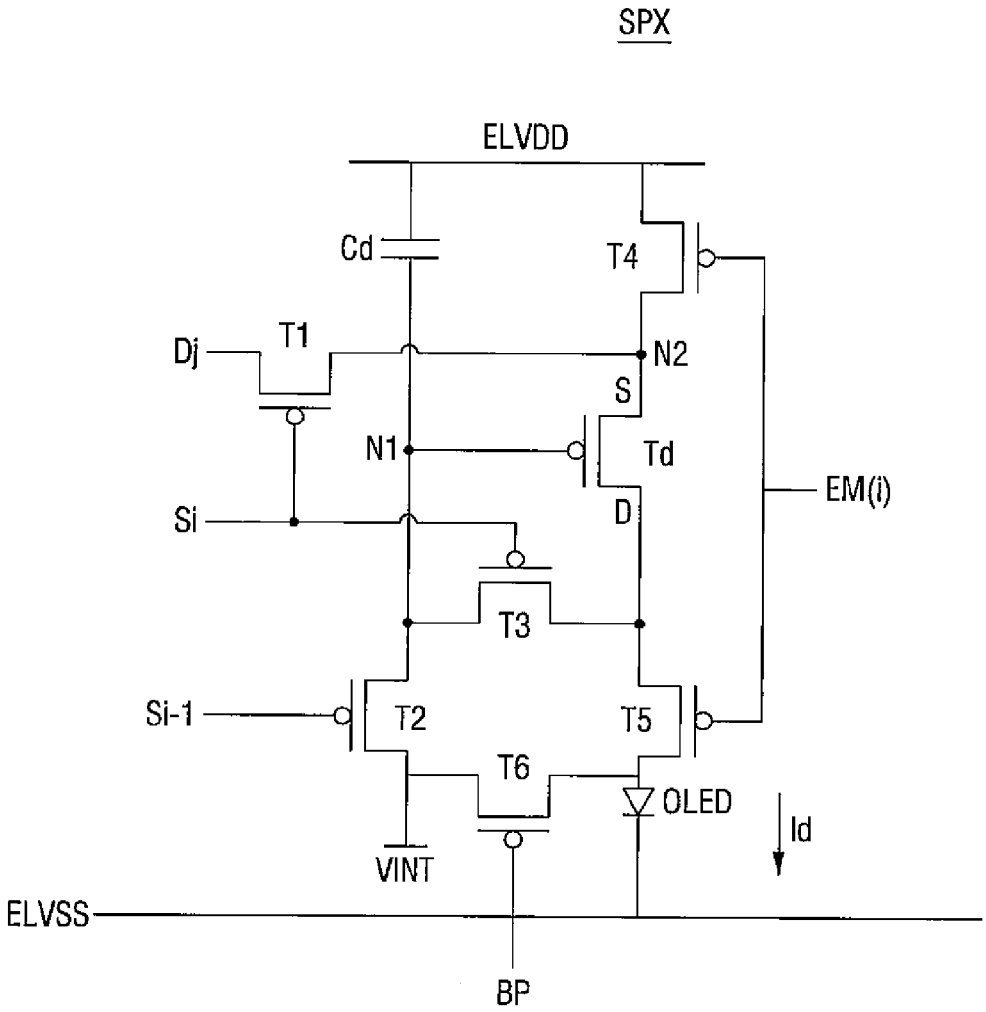
FIG. 2 is a circuit diagram of a subpixel according to an embodiment of the present invention.

FIG. 1 is a block diagram of an organic light-emitting display 10 according to an embodiment of the present invention. FIG. 2 is a circuit diagram of a subpixel SPX according to an embodiment of the present invention.

Referring to FIGS. 1 and 2, the organic light-emitting display 10 includes a display unit 110, a controller 120, a data driver 130, a scan driver 140, and an emission driver 150.

The display unit 110 may be an area where an image is displayed. The display unit 110 may include a plurality of scan lines SL1 through SLn, a plurality of data lines DL1 through DLm crossing the scan lines SL1 through SLn, and a plurality of pixels PX, each coupled to one of the scan lines SL1 through SLn and one of the data lines DL1 through DLm. The scan lines SL1 through SLn may extend along a first direction D1 and may be parallel (or substantially parallel) to each other. The scan lines SL1 through SLn may include first through $n^{th}$ scan lines SL1 through SLn, arranged sequentially. Each of the data lines DL1 through DLm may cross the scan lines SL1 through SLn. That is, the data lines DL1 through DLm may extend along a second direction D2 perpendicular (or substantially perpendicular) to the first direction D1 and may be parallel (or substantially parallel) to each other. Here, the first direction D1 may correspond to a row direction, and the second direction D2 may correspond to a column direction. A plurality of data voltages D1 through Dm may be applied to the data lines DL1 through DLm. In addition, the display unit 110 may further include a plurality of emission lines EL1 through ELn. The emission lines EL1 through ELn may extend side by side with the scan lines SL1 through SLn, but the present invention is not limited thereto.

The pixels PX may be arranged in, but not limited to, a matrix. Each of the pixels PX may include first through third subpixels SPX1 through SPX3. The first through third subpixels SPX1 through SPX3 may be subpixels SPX emitting light of first through third colors. For example, the first subpixel SPX1 may emit, but not limited to, red light, the second subpixel SPX2 may emit, but not limited to, green light, and the third subpixel SPX3 may emit, but not limited to, blue light. Each of the pixels PX may express a certain color by mixing light emitted from the subpixels SPX. Each of the subpixels SPX may be coupled to one of the scan lines SL1 through SLn, one of the data lines DL1 through DLm, and one of the emission lines EL1 through ELn. Each of the subpixels SPX may receive a data voltage applied to a coupled data line in response to a scan signal provided from a coupled scan line. In addition, the degree of light emission of each of the subpixels SPX may be controlled by an emission signal provided from a coupled emission line. A first power supply voltage ELVSS and a second power supply voltage ELVDD generated by a power generator may be applied to the display unit 110 and coupled to each of the subpixels SPX.

Referring to FIG. 2, a subpixel SPX may include a data control transistor T1, an initialization transistor T2, a threshold voltage compensation transistor T3, a first emission control transistor T4, a second emission control transistor T5, a driving transistor Td, a bypass thin-film transistor T6, an organic light-emitting diode OLED, and a driving capacitor Cd. The subpixel SPX of FIG. 2 is merely an example, and the structure of the subpixel SPX is not limited to the structure illustrated in FIG. 2.

The organic light-emitting diode OLED may emit light at a luminance level corresponding to the magnitude of an electric current which flows in a direction from an anode of the organic light-emitting diode OLED to a cathode. The first power supply voltage ELVSS may be applied to the cathode of the organic light-emitting diode OLED. The anode of the organic light-emitting diode OLED may be coupled to a third node N3, and the second emission control transistor T5 may control the connection of the anode of the organic light-emitting diode OLED to the third node N3.

The driving transistor Td may include a source S coupled to a second node N2 to which the second power supply voltage ELVDD is applied, a drain D coupled to the third node N3, and a gate G coupled to a first node N1. The driving transistor Td may receive a $j^{th}$ data voltage Dj through the data control transistor T1 coupled to the second node N2, where j is a natural number from 1 to m. The driving transistor Td may control a driving current Id flowing through the organic light-emitting diode OLED. The magnitude of the driving current Id flowing through the organic light-emitting diode OLED may correspond to a potential difference between the source S and the gate G of the driving transistor Td.

The data control transistor T1 may include a source provided with the $j^{th}$ data voltage Dj, a drain coupled to the second node N2, and a gate provided with an $i^{th}$ scan signal Si. When the $i^{th}$ scan signal Si has an electric potential of a scan-on voltage, the data control transistor T1 may be turned on to provide the $j^{th}$ data voltage Dj to the second node N2.

A first terminal of the driving capacitor Cd may be coupled to the first node N1 which is coupled to the gate G of the driving transistor Td, and the second power supply voltage ELVDD may be applied to a second terminal of the driving capacitor Cd. Therefore, the driving capacitor Cd may store a voltage of the gate G of the driving transistor Td.

The $i^{th}$ scan signal Si may be transmitted to a gate of the threshold voltage compensation transistor T3. When the $i^{th}$ scan signal Si has the electric potential of the scan-on voltage, the threshold voltage compensation transistor T3 is turned on. The turned-on threshold voltage compensation transistor T3 may couple the gate G and the drain D of the driving transistor Td, thereby diode-coupling the driving transistor Td. When the driving transistor Td is diode-coupled, a voltage obtained after the $j^{th}$ data voltage Dj applied to the source S of the driving transistor Td is dropped by a threshold voltage of the driving transistor Td is applied to the gate G of the driving transistor Td. Because the gate G of the driving transistor Td is coupled to the first terminal of the driving capacitor Cd, the voltage applied to the gate G of the driving transistor Td may be maintained. In addition, because the voltage reflecting the threshold voltage of the driving transistor Td is applied to the gate G and maintained accordingly, an electric current flowing between the source S and the drain D of the driving transistor Td may not be affected by the threshold voltage of the driving transistor Td.

An $(i-1)^{th}$ scan signal Si−1 may be transmitted to a gate of the initialization transistor T2. When the $(i-1)^{th}$ scan signal Si−1 has the electric potential of the scan-on voltage, the initialization transistor T2 is turned on to provide an initialization voltage VINT to the gate G of the driving transistor Td. As a result, an electric potential of the gate G of the driving transistor Td may be initialized.

An $i^{th}$ emission control signal EMi may be transmitted to a gate electrode of the first emission control transistor T4. When the $i^{th}$ emission control signal EMi has an electric potential of an emission-on voltage, the first emission control transistor T4 may be turned on to provide the second power supply voltage ELVDD to the second node N2. The $i^{th}$ emission control signal EMi may also be transmitted to a gate electrode of the second emission control transistor T5. When the $i^{th}$ emission control signal EMi has the electric potential of the emission-on voltage, the second emission control transistor T5 may be turned on to couple the third node N3 and the anode of the organic light-emitting diode OLED. When the $i^{th}$ emission control signal EMi has the electric potential of the emission-on voltage, if the first emission control transistor T4 and the second emission control transistor T5 are turned on, the driving current Id corresponding to the $j^{th}$ data voltage Dj stored in the driving capacitor Cd is generated between the source 5 and the drain D of the driving transistor Td for a period of time during which the $i^{th}$ scan signal Si has the electric potential of the scan-on voltage. The driving current Id may flow to the organic light-emitting diode OLED, thus causing the organic light-emitting diode OLED to emit light.

The bypass transistor T6 may include a source electrode coupled to both a drain electrode of the second emission control transistor T6 and the anode of the organic light-emitting diode OLED and a drain electrode coupled to both a source electrode of the initialization transistor T2 and an initialization voltage line. In addition, a bypass signal BP may be transmitted to a gate electrode of the bypass transistor T6 via a bypass control line. The bypass signal BP may be a voltage at a level that can always turn the bypass transistor T6 off. That is, the bypass transistor T6 may always remain off. While the bypass transistor T6 remains off, part of the driving current Id may flow out as a bypass current through the bypass transistor T6. That is, an electric current remaining in the organic light-emitting diode OLED may be removed through the bypass transistor T6 in order to prevent (or substantially prevent) the organic light-emitting diode OLED from emitting light when a black image is displayed.

The controller 120 may receive image data DATA and a timing control signal TCS from an external source. The controller 120 may generate a scan driver control signal SCS, a data driver control signal DCS, and an emission driver control signal ECS corresponding to the timing control signal TCS. In addition, the controller 120 may generate corrected image data sDATA by correcting the image data DATA at intervals of a predetermined number of frames. That is, the controller 120 may provide the uncorrected image data DATA or the corrected image data sDATA to the data driver 130 at intervals of a predetermined number of frames.

The data driver 130 may receive the data driver control signal DCS. In addition, the data driver 130 may receive the image data DATA or the corrected image data sDATA and generate first through $m^{th}$ data voltages D1 through Dm corresponding to the image data DATA or the corrected image data sDATA. The first through $m^{th}$ data voltages D1 through Dm may be applied to the subpixels SPX. The first through $m^{th}$ data voltages D1 through Dm may be signals corresponding to luminance levels of light emitted from the organic light-emitting diodes OLED included in the subpixels SPX.

The scan driver 140 may receive the scan driver control signal SCS and generate first through $n^{th}$ scan signals S1 through Sn corresponding to the scan driver control signal SCS. Each of the first through $n^{th}$ scan signals S1 through Sn may have an electric potential of a scan-on voltage or a scan-off voltage. The first through $n^{th}$ scan signals S1 through Sn may sequentially have the electric potential of the scan-on voltage. When the first through $n^{th}$ scan signals S1 through Sn sequentially have the electric potential of the scan-on voltage, the first through $m^{th}$ data voltages D1 through Dm may be applied to the corresponding subpixels SPX. One of the first through $n^{th}$ scan signals S1 through Sn (i.e., the same scan signal) may be transmitted to subpixels SPX included in the same row.

The emission driver 150 may receive the emission driver control signal ECS and generate first through $n^{th}$ emission signals EM1 through EMn corresponding to the emission driver control signal ECS. Each of the first through $n^{th}$ emission signals EM1 through EMn may have an electric potential of an emission-on voltage or an emission-off voltage. Organic light-emitting diodes OLEDs included in subpixels SPX, which receive the first through $n^{th}$ emission signals EM1 through EMn having the electric potential of the emission-on voltage, may emit light. After an electric potential of an $i^{th}$ scan signal Si changes from the scan-on voltage to the scan-off voltage, an electric potential of an emission signal EMi may change from the emission-off voltage to the emission-on voltage, where i is a natural number from 1 to n.

Here, the controller 120 may generate the corrected image data sDATA by correcting first image data having a first gray level in the input image data DATA to have a second gray level higher than the first gray level. This correction may be performed at intervals of a predetermined number of frames as described above. The characteristics and operation of the controller 120 will now be described in greater detail.

Figure 3:
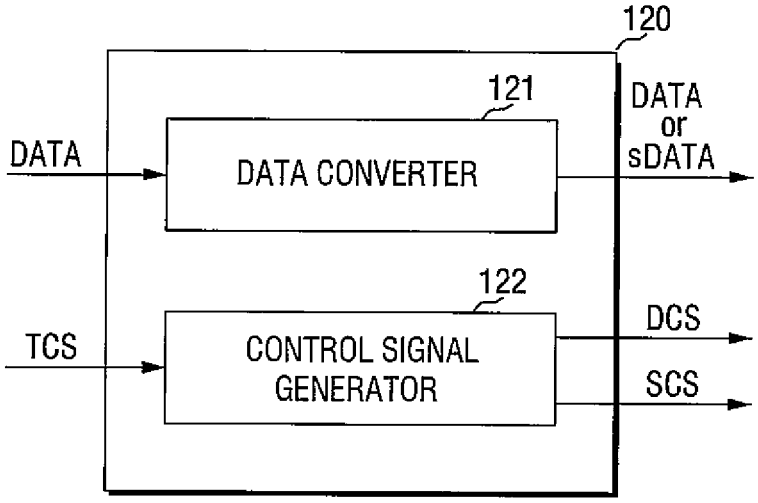
FIG. 3 is a block diagram of a controller according to an embodiment of the present invention.
Figure 4:
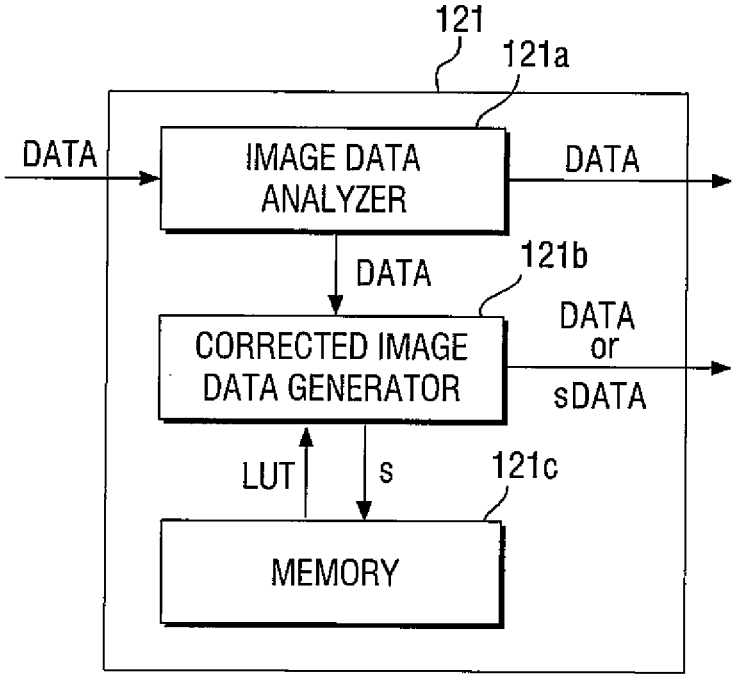
FIG. 4 is a block diagram of a data converter according to an embodiment of the present invention.
Figure 5:
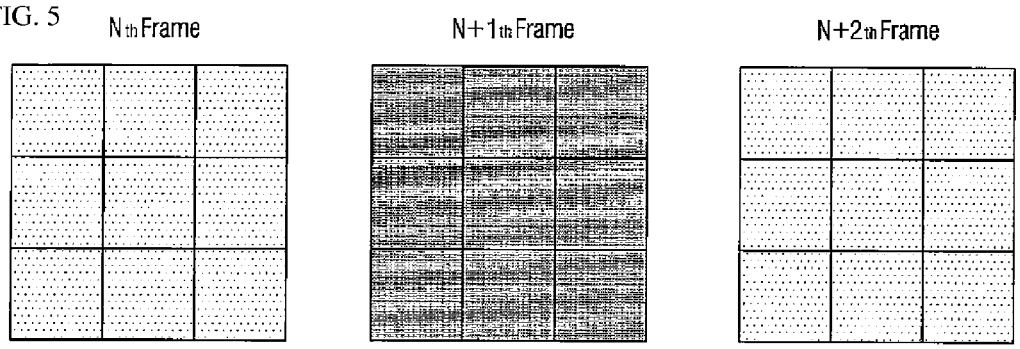
FIG. 5 is a schematic diagram of pixels displaying corrected first image data at intervals of one frame according to an embodiment of the present invention.

FIG. 3 is a block diagram of the controller 120 according to an embodiment of the present invention. FIG. 4 is a block diagram of a data converter 121 according to an embodiment of the present invention. FIG. 5 is a schematic diagram of pixels displaying corrected first image data at intervals of one frame.

Referring to FIGS. 3 through 5, the controller 120 may include the data converter 121 and a control signal generator 122.

The control signal generator 122 may receive the timing control signal TCS and generate the scan control signal SCS for controlling the scan driver 140 and the data control signal DCS for controlling the data driver 130. The timing control signal TCS may be a vertical synchronization signal Vsync, a horizontal synchronization signal Hsync, a data enable signal, and a clock signal CLK. The data control signal DCS may be, e.g., a source start pulse (SSP) and a source sampling clock (SSC). The scan control signal SCS may be a gate start pulse (GSP) and a gate sampling clock (GCS).

The data converter 121 may receive the external image data DATA. The image data DATA may include first color image data provided to the first subpixel SPX1, second color image data provided to the second subpixel SPX2, and third color image data provided to the third subpixel SPX3. The first color image data, the second color image data, and the third color image data may be, but are not limited to, red color image data, green color image data, and blue color image data, respectively. The data converter 121 may analyze each of the first color image data, the second color image data, and the third color image data, and increase a gray level of first image data corresponding to a first gray level among the color image data. Specifically, the data converter 121 may include an image data analyzer 121*a*, a corrected image data generator 121*b*, and a memory 121*c*.

The image data analyzer 121*a* may analyze a gray level of the input image data DATA. That is, the image data analyzer 121*a* may analyze whether the image data DATA includes first image data DATA1 having a first gray level. Here, the first gray level may be a very low gray value. In an example embodiment, the first gray level may have a gray value of zero, and the first image data DATA1 may be black data.

The image data analyzer 121*a* may analyze each of the first color image data, the second color image data and the third color image data and identify whether each of the first color image data, the second color image data and the third color image data has the first gray level. The image data analyzer 121*a* may analyze whether at least one subpixel SPX displays black data due to the input image data DATA. If at least one color image data includes the first image data DATA1 having the first gray level, the image data analyzer 121*a* may provide the image data DATA to the corrected image data generator 121*b*. In addition, if the image data DATA does not include the first image data DATA1, the image data analyzer 121*a* may provide the image data DATA to the data driver 130. In some embodiments, the image data DATA may be converted into pentile data and then provided to the data driver 130.

The corrected image data generator 121*b* may correct the first image data DATA1 having the first gray level in the image data DATA to have a second gray level which is higher than the first gray level. In the image data DATA, image data excluding the first image data DATA1 may not be corrected. For example, the corrected image data generator 121*b* may correct black data having a gray level of zero to produce image data having a gray level higher than zero but may not correct the other image data included in the image data DATA. The corrected first image data DATA1 and the other image data may constitute the corrected image data sDATA.

For image data correction, the corrected image data generator 121*b* may output a selection signal s to the memory 121*d*, and the memory 121*d* may provide correction data LUT in response to the selection signal s. The correction data LUT may be data that increases a gray level of at least one of the first color image data, the second color image data, and the third color image data included in the image data DATA. That is, the corrected image data generator 121*b* may generate the corrected image data sDATA by increasing the gray level of the first image data DATA1 included in at least one color image data based on the correction data LUT.

The corrected image data generator 121*b* may perform this correction process at intervals of N frames. That is, the corrected image data generator 121*b* may selectively correct the input image data DATA at intervals of frames (e.g., a predetermined number of frames). If correcting the image data DATA, the corrected image data generator 121*b* may provide the corrected image data sDATA to the data driver 130. If not correcting the image data DATA, the corrected image data generator 121*b* may provide the uncorrected image data DATA to the data driver 130.

In an example, the corrected image data generator 121*b* may correct the image data DATA at intervals of one frame. Thus, if first image data DATA1(N) of an $N^{th}$ frame is corrected to have the second gray level, first image data DATA1(N+1) of an $(N+1)^{th}$ frame may not be corrected. Then, first image data DATA(N+2) of an $(N+2)^{th}$ frame may be corrected to have the second gray level. That is, as illustrated in FIG. 5, the first image data DATA1(N+1) of the $(N+1)^{th}$ frame may not be corrected, but the first image data DATA1(N) of the $N^{th}$ frame and the first image data DATA (N+2) of the $(N+2)^{th}$ frame may be corrected to have the second gray level.

The corrected image data generator 121*b* may output the corrected image data sDATA to the data driver 130 in the $N^{th}$ frame and the $(N+2)^{th}$ frame and output the image data DATA to the data driver 130 in the $(N+1)^{th}$ frame. The data driver 130 may generate data voltages corresponding to the corrected image data sDATA or the image data DATA and provide the data voltages to the display unit 110. Then, each subpixel SPX of the display unit 110 may emit light corresponding to one of the data voltages. The characteristic of the above image data correction will now be described in greater detail with reference to FIGS. 6 and 7.

Figure 6:
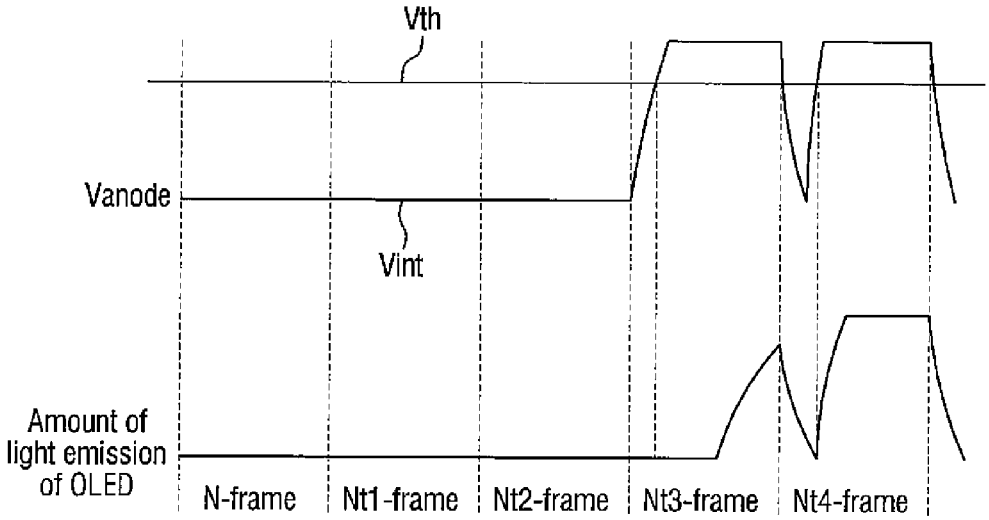
FIG. 6 is a graph illustrating the relationship between the anode voltage and the amount of light emission of an organic light-emitting diode according to an embodiment of the present invention.
Figure 7:
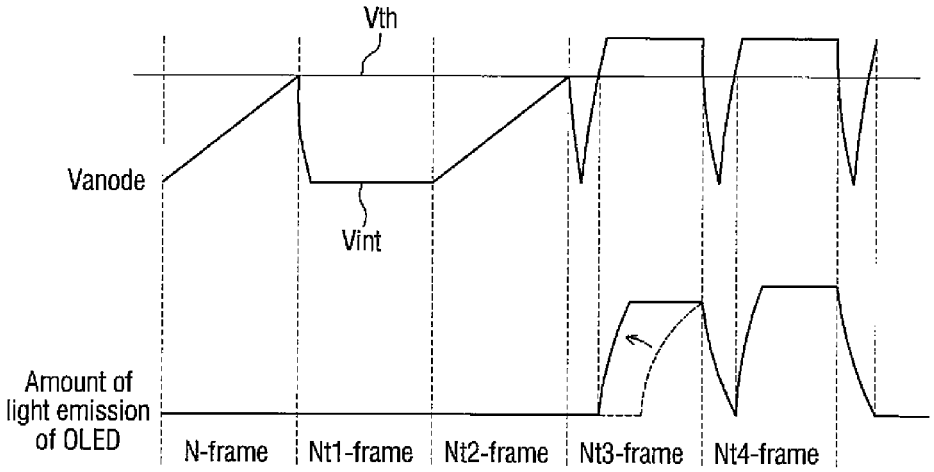
FIG. 7 is a graph illustrating the relationship between the anode voltage and the amount of light emission of an organic light-emitting diode according to an embodiment of the present invention.

FIG. 6 is a graph illustrating the relationship between the anode voltage and amount of light emission of an organic light-emitting diode. FIG. 7 is a graph illustrating the relationship between the anode voltage and the amount of light emission of an organic light-emitting diode according to an embodiment of the present invention.

FIGS. 6 and 7 illustrate the variation in the amount of light emission with respect to an anode voltage Va of an organic light-emitting diode OLED over $N^{th}$ through $(N+4)^{th}$ frames. The organic light-emitting diode OLED may be included in the first subpixel SPX1, the second subpixel SPX2, or the third subpixel SPX3 and may emit light of a first color, a second color, or a third color. Here, the anode voltage Va of the organic light-emitting diode OLED may be a voltage corresponding to a difference between a data voltage stored in the driving capacitor Cd and the second power supply voltage ELVDD, and the amount of light emission of the organic light-emitting diode OLED may be proportional to the driving current Id.

In the $N^{th}$ through $(N+2)^{th}$ frames, first image data, that is, black data may be provided. Accordingly, the anode voltage Va of the organic light-emitting diode OLED may be formed lower than a threshold voltage Vth of the driving transistor Td. As a result, the organic light-emitting diode OLED may not emit light. On the other hand, in the $(N+3)^{th}$ through $(N+4)^{th}$ frames, image data that causes the anode voltage Va higher than the threshold voltage Vth to be applied to the organic light-emitting diode OLED may be provided. That is, the organic light-emitting diode OLED may emit light to a set luminance level.

In FIG. 6, first image data of the $N^{th}$ frame and the $(N+2)^{th}$ frame may not be corrected to have the second gray level. Here, the first image data may have a very low gray level, and the subpixels SPX may substantially display black. The organic light-emitting diode OLED, which has not emitted light during successive frames, may not emit light immediately even if the anode voltage Va equal to or higher than the threshold voltage Vth is applied to the organic light-emitting diode OLED in the $(N+3)^{th}$ frame. Because the driving capacitor Cd is initialized by the initialization voltage VINT, It requires time to charge the driving capacitor Cd. Therefore, the light emission of the organic light-emitting diode OLED may be delayed. Accordingly, the organic light-emitting diode OLED may not fully emit light to a desired luminance level, resulting in color blurring.

On the other hand, in the current embodiment of FIG. 7, the first image data of the $N^{th}$ frame and the $(N+2)^{th}$ frame may be corrected to have the second gray level. That is, the first image data may be corrected at intervals of one frame. However, this is merely an example, and, in another embodiment, the first image data may be corrected at intervals of two frames.

In the $N^{th}$ frame and the $(N+2)^{th}$ frame during which correction is performed, a data voltage corresponding to the second gray level may be provided to the driving capacitor Cd as described above. That is, in each frame, the driving capacitor Cd may be charged with the data voltage corresponding to the second gray level or may be discharged. The data voltage may function as a kind of pre-charge voltage and thus increase the charge efficiency of the driving capacitor Cd. Therefore, the driving capacitor Cd can be charged in the $(N+3)^{th}$ frame far faster than in FIG. 6, and the emission delay of the organic light-emitting diode OLED can be prevented, substantially prevented, or reduced.

Even if the first image data is corrected to have the second gray level, a voltage lower than the threshold voltage Vth can be provided to the organic light-emitting diode OLED. That is, the anode voltage Va of the organic light-emitting diode OLED, which corresponds to a potential difference between the data voltage corresponding to the second gray level and the second power supply voltage ELVDD, may have a voltage value lower than the threshold voltage Vth. In addition, even if the second gray level is a gray value that can provide a high voltage, the anode voltage Va of the organic light-emitting diode OLED may not be formed higher than the threshold voltage Vth due to hysteresis characteristics of the driving transistor Td, which may be caused by the charging or discharging of the driving transistor Td at intervals of a predetermined number of frames. Therefore, the organic light-emitting diode OLED may not emit light in the $N^{th}$ through $(N+2)^{th}$ frames, and each subpixel SPX including the organic light-emitting diode OLED may remain substantially black.

That is, the organic light-emitting display according to the current embodiment may correct black data to have a predetermined gray level at intervals of a predetermined number of frames. Therefore, the organic light-emitting display according to the current embodiment may display a black image during a black image period and prevent, substantially prevent, or reduce an emission delay that may occur when an organic light-emitting diode intends to emit light. This can prevent, substantially prevent, or reduce color blurring, thereby improving display quality.

An organic light-emitting display according to another embodiment of the present invention will now be described. In the following embodiment, some repetitive description of elements identical to those described above will be omitted or given briefly. The following embodiment will be described with reference to some differences with the previous embodiment.

Figure 8:
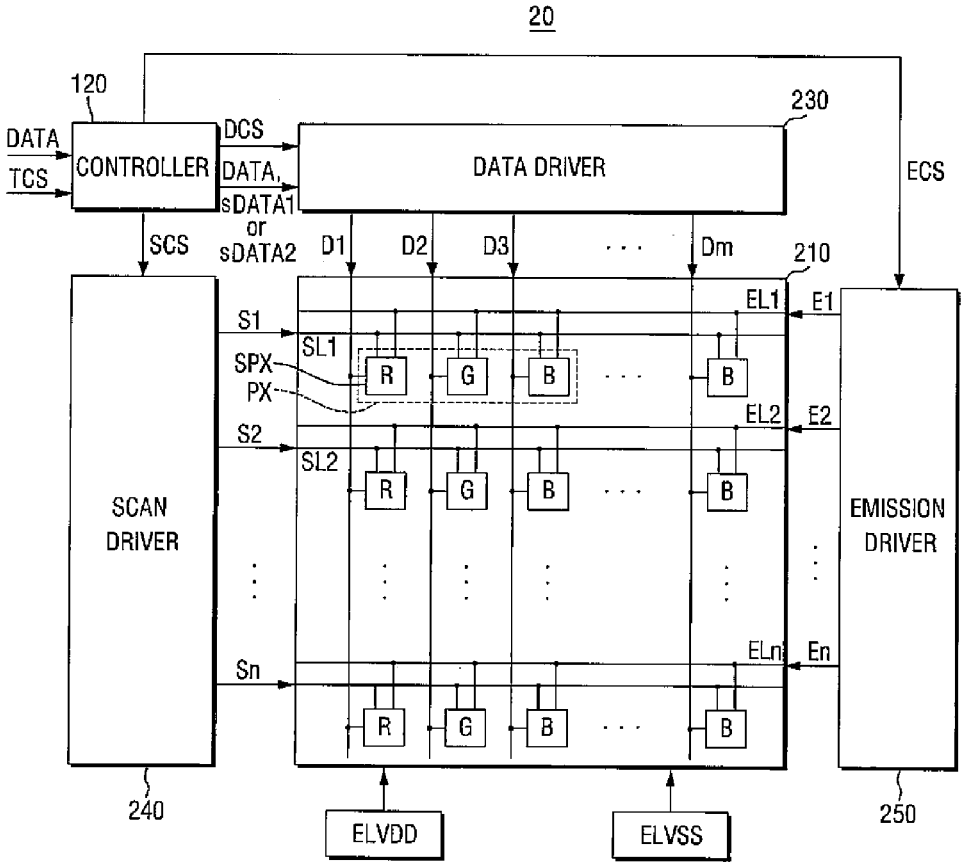
FIG. 8 is a block diagram of an organic light-emitting display according to an embodiment of the present invention.
Figure 9:
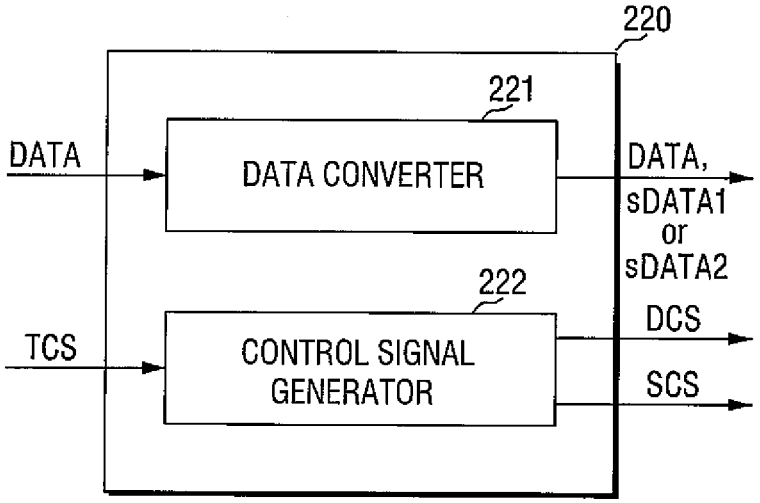
FIG. 9 is a block diagram of a controller according to an embodiment of the present invention.
Figure 10:
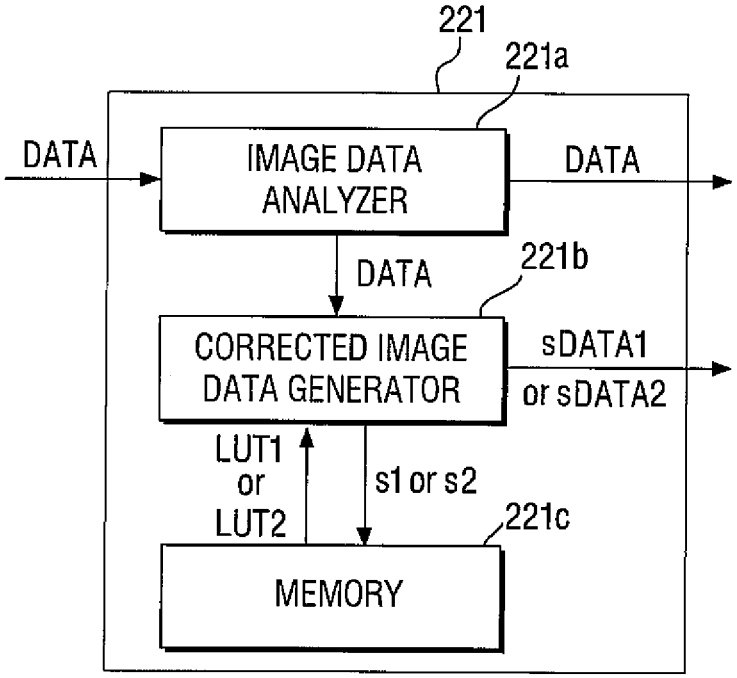
FIG. 10 is a block diagram of a data converter according to an embodiment of the present invention.
Figure 13:
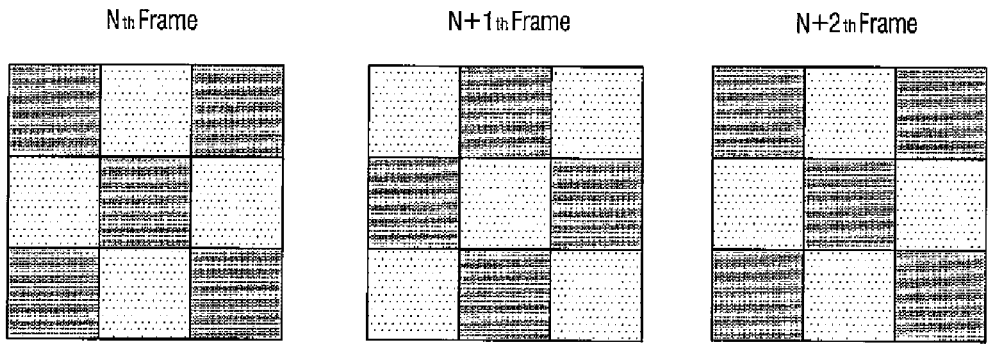
FIG. 13 is a diagram schematically illustrating the correction of first image data in each frame according to an embodiment of the present invention.

FIG. 8 is a block diagram of an organic light-emitting display 20 according to another embodiment of the present invention. FIG. 9 is a block diagram of a controller 220 according to another embodiment of the present invention. FIG. 10 is a block diagram of a data converter 221 according to another embodiment of the present invention. FIG. 11 is a schematic diagram of first correction data LUT1. FIG. 12 is a schematic diagram of second correction data LUT2. FIG. 13 is a diagram schematically illustrating the correction of first image data in each frame according to another embodiment of the present invention.

Referring to FIGS. 8 through 13, the controller 220 of the organic light-emitting display 20 according to the current embodiment may receive image data DATA and a timing control signal TCS from an external source. The controller 220 may correct the image data DATA to first corrected image data sDATA1 or second corrected image data sDATA2 at intervals of a predetermined number of frames. The controller 220 may include the data converter 221 and a control signal generator 222, and the data converter 221 may include an image data analyzer 221*a*, a corrected image data generator 221*b*, and a memory 221*c*.

The image data analyzer 221*a* may analyze a gray level of the image data DATA. That is, the image data analyzer 221*a* may analyze whether the image data DATA includes first image data DATA1 having a first gray level. The image data analyzer 221*a* may analyze each of first color image data, second color image data, and third color image data, and identify whether each of the first color image data, the second color image data and the third color image data has the first gray level. Here, the first gray level may be a very low gray value. In an example embodiment, the first gray level may be a gray value of zero, and the first image data DATA1 may be black data. The image data analyzer 221*a* may analyze whether at least one subpixel SPX displays black data due to the image data DATA. If the image data DATA includes the first image data DATA1 having the first gray level, the image data analyzer 221*a* may provide the image data DATA to the corrected image data generator 221*b*. In addition, if the image data DATA does not include the first image data DATA1, the image data analyzer 221*a* may provide the image data DATA to the data driver 130.

The corrected image data generator 221*b* may correct the first image data DATA1 having the first gray level in the image data DATA to have a second gray level, which is higher than the first gray level. That is, the corrected image data generator 221*b* may correct black data having a gray level of zero to produce image data having a gray level higher than zero. This correction may be performed using the first correction data LUT1 and the second correction data LUT2. That is, the corrected image data generator 221*b* may convert the image data DATA into the first corrected image data sDATA1 based on the first correction data LUT1 and convert the image data DATA into the second corrected image data sDATA2 based on the second correction data LUT2. The corrected image data generator 221*b* may read out the first correction data LUT1 by outputting a first selection signal s1 to the memory 221*d* and read out the second correction data LUT2 by outputting a second selection signal s2 to the memory 221*d*.

The first correction data LUT1 and the second correction data LUT2 may be data that increase a gray level of at least one of the first color image data, the second color image data, and the third color image data. That is, the corrected image data generator 221*b* may increase the first gray level of the first image data DATA1 included in at least one color image data to the second gray level, which is higher than the first gray level, based on the first correction data LUT1 or the second correction data LUT2. Referring to FIGS. 11 and 12, the first correction data LUT1 and the second correction data LUT2 may increase the gray level of the second color image data, which causes green subpixels to emit light, from a gray value of zero to a gray value of three. However, this is merely an example, and a gray value to which the gray level of the second color image data is corrected is not limited to three.

The first correction data LUT1 and the second correction data LUT2 may correct the gray level of the first image data input to different pixels. Assuming that one block of the correction data LUT corresponds to one pixel PX, a pixel whose gray value is corrected by the first correction data LUT1 may not have its gray value corrected by the second correction data LUT2. That is, the gray value of any one pixel PX may be increased by the first correction data LUT1 but not by the second correction data LUT2.

The first selection signal S1 and the second selection signal s2 may be output periodically at intervals of a predetermined number of frames. For example, the first selection signal S1 and the second selection signal s2 may be alternately output every frame, but the present invention is not limited thereto. Because the first correction data LUT1 and the second correction data LUT2 are output in response to the first selection signal s1 and the second selection signal s2, they may also be provided at the intervals of the predetermined number of frames. Therefore, the first corrected image data sDATA1 and the second corrected image data sDATA2 may also be generated at the intervals of the frames (e.g., a predetermined number of frames), and the generated first corrected image data sDATA1 or the generated second corrected image data sDATA2 may be output to the data driver 130. Accordingly, pixels PX to which the first image data is applied may be corrected to have the second gray level at the intervals of the frames (e.g., a predetermined number of frames).

In addition, the first correction data LUT1 and the second correction data LUT2 may not correct the first image data provided to pixels PX arranged successively. That is, referring to FIG. 13, pixels PX neighboring, in a row or column direction, a pixel PX whose gray value is corrected by the first correction data LUT1 may not be corrected by the first correction data LUT1. In addition, pixels PX neighboring, in the row or column direction, a pixel PX whose gray value is corrected by the second correction data LUT2 may not be corrected by the second correction data LUT2. When any one pixel PX has the second gray level, pixels PX neighboring the pixel PX in the column or row direction may have the first gray level. That is, the first correction data LUT1 and the second correction data LUT2 may increase the gray level of the first image data applied to each pixel PX in a dot-inversion manner.

Accordingly, not the entire first image data provided in one frame may be corrected to have the second gray level. Instead, the first image data may be partially corrected to have the second gray level. That is, the organic light-emitting display 20 according to the current embodiment may not entirely correct the first image data for displaying substantially a black screen to have the second gray level. Therefore, the organic light-emitting display 20 according to the current embodiment may provide a clearer black screen than the organic light-emitting display 10 of FIGS. 1 through 7, which corrects the gray level of the first image data on a frame-by-frame basis.

Other elements of the organic light-emitting display 20 are substantially similar to those included in the organic light-emitting display 10 of FIGS. 1 through 7, and thus some repetitive description thereof will be omitted.

Figure 14:
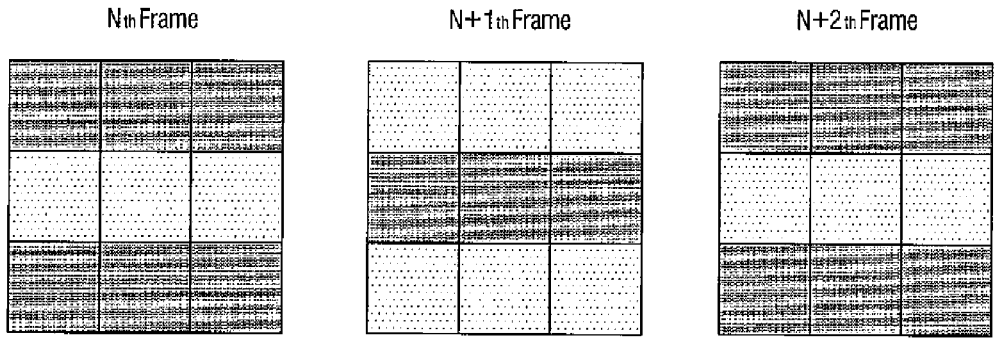
FIG. 14 is a diagram schematically illustrating the correction of first image data in each frame according to an embodiment of the present invention.

FIG. 14 is a diagram schematically illustrating the correction of first image data in each frame according to another embodiment of the present invention.

Referring to FIG. 14, the first image data may be partially corrected to have a second gray level based on a row direction of each frame. In this case, the same characteristic as the characteristic obtained by the organic light-emitting display 20 of FIGS. 8 through 13 can be provided.

A method of driving an organic light-emitting display according to an embodiment of the present invention will now be described.

Figure 15:
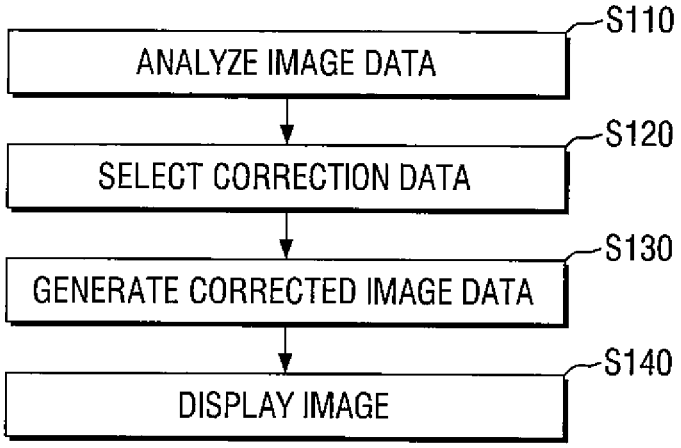
FIG. 15 is a flowchart illustrating a method of driving an organic light-emitting display according to an embodiment of the present invention.

FIG. 15 is a flowchart illustrating a method of driving an organic light-emitting display according to an embodiment of the present invention. For a more detailed description, FIGS. 1 through 7 will also be referred to.

The method of driving an organic light-emitting display according to the current embodiment includes analyzing image data (operation S110), generating corrected image data (operation S120), and displaying an image (operation S130).

Image data is analyzed at operation S110.

The image data may be analyzed whether image data DATA input from an external source includes first image data having a first gray level. Here, the first gray level may be a very low gray value. In an example embodiment, the first gray level may have a gray value of zero, and the first image data may be black data. The image data DATA may include first color image data provided to a first subpixel SPX1, second color image data provided to a second subpixel SPX2, and third color image data provided to a third subpixel SPX3. The first color image data, the second color image data, and the third color image data may be, but are not limited to, red color image data, green color image data, and blue color image data, respectively. That is, each of the first color image data, the second color image data, and the third color image data may be analyzed to identify whether each of the first color image data, the second color image data, and the third color image data has the first gray level. If at least one of the first color image data, the second color image data, and the third color image data includes the first image data, the first image data having the first gray level may be corrected to have the second gray level (operation S120). If none of the first color image data, the second color image data, and the third color image data includes the first image data, the image data DATA may not be corrected, and an image corresponding to the uncorrected image data DATA may be displayed (operation S130).

Next, corrected image data is generated (operation S120).

Of the image data DATA, only the first image data may be corrected. That is, of the image data DATA, image data having a gray level other than the first gray level may not be corrected. The corrected first image data and the other image data may form corrected image data sDATA.

The first image data may be corrected at intervals of N frames. That is, even if the input image data DATA includes the first image data, it may not be corrected in a frame during which correction is not performed, and thus an image corresponding to the uncorrected image data DATA may be displayed in the frame (operation S130). For example, the image data DATA may be corrected at intervals of one frame. That is, if first image data DATA1(N) of an $N^{th}$ frame is corrected to have the second gray level, first image data DATA1(N+1) of an $(N+1)^{th}$ frame may not be corrected. Then, first image data DATA(N+2) of an $(N+2)^{th}$ frame may be corrected to have the second gray level.

The method of driving an organic light-emitting display according to the current embodiment may further include selecting correction data needed to generate the corrected image data (operation S112) before the generating of the corrected image data (operation S120). In the selecting of the correction data (operation S112), a selection signal s for reading out correction data LUT may be output at intervals of N frames. The corrected image data sDATA may be generated by correcting the image data DATA based on the correction data LUT.

Finally, an image corresponding to the corrected image data sDATA is displayed (operation S130).

Here, the first image data is image data for displaying a low gray level. That is, the first image data may be substantially black data. Therefore, in a frame during which correction is not performed, pixels displaying the first image data may display a black image. Even if the first image data is corrected to have the second gray level in a certain frame, pixels displaying the corrected first image data may also display substantially a black image. That is, even if the first image data is corrected to have the second gray level, it may provide a voltage lower than a threshold voltage Vth. In other words, an anode voltage of an organic light-emitting diode OLED which corresponds to a potential difference between a data voltage corresponding to the second gray level and a second power supply voltage ELVDD may have a voltage value lower than the threshold voltage Vth. In addition, even if the second gray level is a gray value that can provide a high voltage, the anode voltage of the organic light-emitting diode OLED may not be formed higher than the threshold voltage Vth due to hysteresis characteristics of a driving transistor which may be caused by the charging or discharging of the driving transistor at intervals of a predetermined number of frames. Therefore, the organic light-emitting diode OLED which receives the first image data having the second gray level may not emit light.

Although the voltage corresponding to the second gray level fails to make the organic light-emitting diode OLED emit light, it may function as a kind of pre-charge voltage, thereby increasing the charge efficiency of a driving capacitor Cd. Accordingly, because the driving capacitor Cd can be charged fast, the emission delay of the organic light-emitting diode OLED can be prevented (or substantially prevented).

That is, in the method of driving an organic light-emitting display according to the current embodiment, black data may be corrected to have a gray level (e.g., a predetermined gray level) at intervals of a predetermined number of frames. Therefore, a black image can be displayed during a black image period, and an emission delay that may occur when an organic light-emitting diode intends to emit light can be prevented (or substantially prevented). Accordingly, this color blurring may be prevented, substantially prevented, or reduced, thereby improving display quality.

Other elements used in the method of driving an organic light-emitting display are substantially similar to those included in the organic light-emitting display 10 of FIGS. 1 through 7, and thus some repetitive description thereof will be omitted.

Some embodiments of the present invention include at least one of the following characteristics.

It may be possible to prevent or substantially prevent the emission delay of a certain subpixel, thereby improving display quality.

However, the characteristics of the present invention are not restricted to those set forth herein. The above and other aspects of the present invention will become more apparent to one of daily skill in the art to which the present invention pertains by referencing the claims, and their equivalents.

What is claimed is:

1. An organic light-emitting display comprising:

a display unit comprising a plurality of pixels; and a controller configured to correct first image data that is black data having a first gray level, which is included in image data, to have a second gray level that is higher than the first gray level based on first correction data or second correction data, wherein each pixel comprises:

an organic light-emitting diode configured to emit light;

a driving transistor configured to control a driving current flowing through the organic light-emitting diode;

a driving capacitor configured to provide a gate voltage to the driving transistor;

a threshold voltage compensation transistor having a first terminal coupled to a drain of the driving transistor, and having a second terminal coupled to the driving capacitor and a gate of the driving transistor;

a bypass transistor coupled in parallel to the threshold voltage compensation transistor, having a first terminal directly coupled to an anode of the organic light-emitting diode, and having a second terminal coupled to an initialization voltage; and an initialization transistor having a first terminal coupled to the driving capacitor and to the gate of the driving transistor, and having a second terminal coupled to the initialization voltage, wherein the driving capacitor is configured to be charged with a data voltage corresponding to the second gray level at intervals of N frames, where N is an integer of one or more, and wherein the controller is configured to correct the first image data at the intervals of N frames.

2. The organic light-emitting display of claim 1, wherein the controller comprises:

an image data analyzer configured to analyze whether or not the image data comprises the first image data;

a corrected image data generator configured to output a selection signal at the intervals of the N frames; and a memory configured to provide the first correction data or the second correction data to the corrected image data generator in response to the selection signal, wherein the corrected image data generator is configured to generate corrected image data by correcting the first image data, which is included in the image data, based on the first correction data or the second correction data.

3. The organic light-emitting display of claim 1, wherein the image data comprises first color image data, second color image data, and third color image data, and each of the pixels comprises:

a first subpixel configured to display the first color image data;

a second subpixel configured to display the second color image data; and a third subpixel configured to display the third color image data.

4. The organic light-emitting display of claim 3, wherein the controller is configured to correct the first gray level of the first image data included in at least one of the first color image data, the second color image data, and the third color image data to the second gray level.

5. The organic light-emitting display of claim 1, wherein the first gray level has a gray value of zero.

6. An organic light-emitting display comprising:

a display unit comprising a plurality of pixels; and a controller configured to correct first image data that is black data having a first gray level, which is included in image data, to have a second gray level that is higher than the first gray level based on first correction data or second correction data provided alternately at intervals of N frames, wherein a pixel displaying the first image data corrected based on the first correction data and a pixel displaying the first image data corrected based on the second correction data are different, where N is an integer of one or more, wherein each pixel comprises:

an organic light-emitting diode configured to emit light;

a driving transistor configured to control a driving current flowing through the organic light-emitting diode;

a driving capacitor configured to provide a gate voltage to the driving transistor;

a threshold voltage compensation transistor having a first terminal coupled to a drain of the driving transistor, and having a second terminal coupled to the driving capacitor and a gate of the driving transistor;

a bypass transistor coupled in parallel to the threshold voltage compensation transistor, having a first terminal directly coupled to an anode of the organic light-emitting diode, and having a second terminal coupled to an initialization voltage; and an initialization transistor having a first terminal coupled to the driving capacitor and to the gate of the driving transistor, and having a second terminal coupled to the initialization voltage, wherein the driving capacitor is configured to be charged with a data voltage corresponding to the second gray level at the intervals of N frames, and wherein the data voltage corresponding to the second gray level causes an anode voltage of the organic light-emitting diode to be lower than a threshold voltage of the driving transistor.

7. The organic light-emitting display of claim 6, wherein the controller comprises:

an image data analyzer configured to analyze whether or not the image data comprises the first image data;

a corrected image data generator configured to alternately output a first selection signal and a second selection signal at the intervals of the N frames; and a memory configured to provide the first correction data and the second correction data to the corrected image data generator in response to the first selection signal and the second selection signal, respectively, wherein the corrected image data generator is configured to generate corrected image data by correcting the first image data, which is included in the image data, based on the first correction data or the second correction data.

8. The organic light-emitting display of claim 6, wherein the first gray level has a gray value of zero.

9. A method of driving an organic light-emitting display, the method comprising:

analyzing image data input from an external source;

generating first and second corrected image data by correcting first image data that is a black data having a first gray level, which is included in the image data, to have a second gray level that is higher than the first gray level; and displaying an image corresponding to the first corrected image data or the second corrected image data, wherein the first corrected image data is generated by correcting the first image data at intervals of N frames, where N is an integer of one or more, wherein each pixel of a plurality of pixels comprises an organic light-emitting diode configured to emit light;

a driving transistor configured to control a driving current flowing through the organic light-emitting diode;

a driving capacitor configured to provide a gate voltage to the driving transistor;

a threshold voltage compensation transistor having a first terminal coupled to a drain of the driving transistor, and having a second terminal coupled to the driving capacitor and a gate of the driving transistor;

a bypass transistor coupled in parallel to the threshold voltage compensation transistor, having a first terminal directly coupled to an anode of the organic light-emitting diode, and having a second terminal coupled to an initialization voltage; and an initialization transistor having a first terminal coupled to the driving capacitor and to the gate of the driving transistor, and having a second terminal coupled to the initialization voltage, and wherein the driving capacitor is configured to be charged with a data voltage corresponding to the second gray level at the intervals of N frames.

10. The method of claim 9, wherein the analyzing of the image data comprises determining whether or not the image data comprises the first image data.

11. The method of claim 9, further comprising selecting correction data for the generating of the first and second corrected image data after the analyzing of the image data, wherein the selecting of the correction data comprises reading out the correction data by outputting a selection signal at the intervals of the N frames.

12. The method of claim 9, wherein the image data comprises first color image data, second color image data, and third color image data, and in the generating of the first and second corrected image data, the first gray level of the first image data included in at least one of the first color image data, the second color image data, and the third color image data is corrected to the second gray level.

13. The method of claim 9, wherein the first gray level has a gray value of zero.

* * * * *